US005851444A

United States Patent [19]

Hansell, Jr. et al.

[11] Patent Number: 5,851,444

[45] Date of Patent: Dec. 22, 1998

[54] AIR-TREATING APPARATUS HAVING IMPROVED WATER DISTRIBUTION TRAY

[75] Inventors: Martin A. Hansell, Jr., Marietta, Ohio; Earl K. Lewis, II, Williamstown, W. Va.

[73] Assignee: Skuttle Manufacturing Company, Marietta, Ohio

[21] Appl. No.: 816,552

[22] Filed: Mar. 13, 1997

[51] Int. Cl.[6] ..... B01F 3/04

[52] U.S. Cl. ..... 261/106; 239/379; 239/553.3; 261/97; 261/DIG. 4

[58] Field of Search ..... 137/561 A; 239/379, 239/553.3; 261/19, 74, 29, 97, 103, 106, DIG. 15, DIG. 4

[56] References Cited

U.S. PATENT DOCUMENTS

| | | | |
|---|---|---|---|
| 951,991 | 3/1910 | Hase . | |
| 2,035,728 | 3/1936 | Schenectady | 299/58 |
| 2,054,541 | 10/1936 | Hettinger | 261/106 |
| 2,947,452 | 8/1960 | Frohmader et al. | 261/106 |
| 3,139,462 | 6/1964 | Scott | 261/70 |
| 3,193,259 | 7/1965 | Liebmann et al. | 261/24 |
| 3,284,068 | 11/1966 | Goettl | 261/97 |
| 3,570,822 | 3/1971 | Peterson et al. | 261/106 |
| 3,867,486 | 2/1975 | Nagele | 261/106 |
| 3,975,470 | 8/1976 | Engel | 261/106 |
| 4,125,576 | 11/1978 | Kozinski | 261/106 |
| 4,158,679 | 6/1979 | Yeagle | 261/106 |
| 4,338,264 | 7/1982 | Seeley | 261/106 |
| 4,460,520 | 7/1984 | Wrightson | 261/106 |
| 4,657,709 | 4/1987 | Goettl | 261/106 |

FOREIGN PATENT DOCUMENTS 886173 1/1962 United Kingdom .

OTHER PUBLICATIONS

"Meet General's New 1099 Humidifier" by General Filters, Inc. Product Brochure (undated).

"The New 1042 power Humidifier" by General Filters, Inc. Product Brochure (undated).

*Primary Examiner*—C. Scott Bushey

*Attorney, Agent, or Firm*—Renner, Kenner Greive, Bobak, Taylor & Weber

[57] ABSTRACT

A humidifier (10) includes a water distribution tray (18) that functions to substantially uniformly distribute water to an evaporator pad (16) even when the distribution tray (18) is tilted and regardless of the rate of water flow. The distribution tray (18) includes a plurality of channels (100) that each lead from a liquid reception area (104) to an opening (106) in the bottom wall (82) of the tray (18). A wick (110) fabricated from a water absorbent material is carried by the tray (18) at the reception area (104). The wick (110) may extend at least partially into each channel (100), and absorbs water and pushes it into each of the channels (100) through capillary action. Thus, each channel (100) receives water even if the tray (18) is tilted. The humidifier (10) also has a damming rib (72) that prevents water from draining from the pad (16) out of the humidifier (10).

7 Claims, 6 Drawing Sheets

AIR-TREATING APPARATUS HAVING IMPROVED WATER DISTRIBUTION TRAY

TECHNICAL FIELD

This invention relates generally to air-treating apparatus such as, for example, furnace-mounted humidifiers. More particularly, this invention relates to means for substantially uniformly distributing water or other flowable liquids from a single source to multiple delivery points within the humidifier regardless of the flow rate of the water. Specifically, this invention relates to a water distribution tray or trough for channeling the flow of water substantially evenly from a single source to multiple delivery areas for dispersement over an evaporator pad in order to more uniformly wet the entire evaporator pad area, thereby increasing the efficiency of the humidifier. It will be appreciated that the water distribution tray is effective in uniformly dispensing water over the evaporator pad even at minimal rates of flow and even if the entire apparatus is not perfectly level. Still other improvements to the air-treating apparatus of the present invention include the integral, one-piece construction of the mounting back, containment device and drain, improved mounting means for the water solenoid, and the capability of adding two by-pass collars to the apparatus for performance enhancement.

BACKGROUND OF THE INVENTION

Increasing the humidity of the air in building is especially desirable in the wintertime. Such humidification is typically accomplished through the use of an air-treating apparatus generally known as a humidifier. In general, a humidifier increases the moisture content of the air by providing a moistened evaporator pad through which air is forced. The air flow causes water from the evaporator pad to evaporate thus increasing the moisture content of the air.

For purposes of convenience, the air-treating apparatus of the present invention will often be referred to as a humidifier. However, it will be appreciated that the air-treating apparatus of the present invention may have other primary abilities, such as air temperature control, and may have different configurations than that described herein. Therefore, the present invention should not necessarily be limited to those apparatus known commercially as humidifiers, it being understood that the present invention may have applicability and utility in other industries and to other apparatus capable of performing the functions described herein.

Generally, an air-treating apparatus includes a housing and some sort of evaporator means mounted therein. Evaporator pads are typically used in humidifiers and are specifically discussed herein, but it will be appreciated that other means such as wood slats, as typically used in cooling towers, and other types of evaporator articles have also been employed in various air-treating apparatus and may be suitable for the present invention.

An evaporator pad typically comprises multiple layers of water absorbent material which form a mesh-like structure that may be continuously wetted, typically from above. Aluminum mesh is one common material from which the evaporator pad may be typically fabricated. The proper distribution of water onto the evaporator pad is an important consideration in the design of a humidifier. Desirably, the water should be uniformly distributed over the entire evaporator pad. When water is unevenly distributed, the humidifier is less efficient since one part of the evaporator pad may not be used while another part may be oversaturated, causing water run-off.

Providing uniform distribution is particularly difficult because humidifiers are often unevenly mounted when installed. Such errors in installation typically result in the apparatus being tilted slightly to one side when it is mounted. Even when an apparatus is mounted in accordance with the mounting instructions, the apparatus may still not be perfectly level because the duct or plenum on which it is mounted may be tilted to some degree. In either case, the efficiency of the humidifier is typically reduced because water is unevenly distributed onto the evaporator pad.

One solution to the problem of unequal distribution of water due to tilted installation is to provide a source of water for each delivery point above the evaporator pad. It will readily be appreciated that this "multiple source" arrangement, while functional, is much more costly in terms of both the number of additional parts required and the amount of water used. Thus, the solution is not seen in the industry as being a practical alternative.

Another solution to this problem is to provide extremely deep channels in a distribution tray located above the evaporator pad that will fill with water and overcome the angle of tilt. Although potentially functional, this method is also very inefficient and costly. Clearly, in order to overcome the angle of tilt, significant amounts of water will be necessary and even then, the amount of water received by one side of the evaporator pad might not be equal to the amount of water received at the other side, unless there is a sufficient rate of water flow to cause the desired result. The design of a high-walled distribution tray also tends to undesirably enlarge the overall dimensions of the humidifier.

U.S. Pat. No. 3,193,259 to Liebmann discloses another structure that attempts to solve the uneven distribution problem. Liebmann provides an elongate distribution channel having multiple distribution apertures. Each aperture is substantially surrounded by a cylindrical riser wall having a V-shaped metering notch. The metering notches somewhat control the flow of water through the aperture onto an evaporator pad. Although the notches somewhat control the flow, it still requires a high rate of flow in order to operate properly, and a tilted disposition will continue to cause in an uneven distribution.

U.S. Pat. No. 3,975,470 to Engel attempts to resolve the problem of unequal distribution of water when the humidifier is not perfectly level by metering the flow of water to a plurality of channels. That is, this patent discloses a distribution tray having multiple channels leading away from a centrally-disposed reservoir. A V-shaped metering notch is disposed between each channel and the reservoir, and this controls the flow of water to each channel. Although such notches are useful to control and meter the amount of water to flow into each channel, they are not particularly useful for ensuring substantially uniform water distribution over the evaporation pad when the tray is tilted. That is, like Liebmann, the flow rate of the water must be relative high in order for the tray to work properly.

Yet another attempt to resolve the problem of uneven distribution is disclosed in U.S. Pat. No. 4,125,576 to Kozinski which discloses a water distributor trough. The trough has a plurality of channels leading away from a centrally-disposed, raised target element such that when water is discharged from a supply hose, it contacts the target element and has a substantially even opportunity to run along any of the channel walls before falling into any one of the channels. However, the water dropping onto the target element must have sufficient velocity to provide enough momentum to travel along the walls before spilling into the channels.

One disadvantage of this design is the relatively small target area that the incoming water must contact to be properly distributed. When the humidifier is installed even at the slightest angle, the exact location of the incoming water is altered. Thus, by tilting the distribution tray, the even distribution of water into the channels is lost. Another disadvantage is the relatively high flow rate of water that is required to evenly distribute the water. The relatively high flow rate results in waste and causes the humidifier to be inefficient.

In each of the above examples, a high flow rate is necessary in order to solve the problem of uneven distribution. Typically, the flow rate for these humidifiers is on the order of 6 to 7 gallons of water per hour. Since only about 0.75 gallons of water are typically evaporated per hour, it is easily to understand that these humidifiers are extremely inefficient.

In view of the foregoing, it is desirable to provide a humidifier having a liquid distribution tray that substantially evenly distributes liquid from a single source to a plurality of delivery points over the evaporator pad, regardless of the flow rate of the water and even when the tray is not perfectly level. A flow rate of 3 gallons per hour or less would be considered much more efficient.

Beyond the housing, evaporator means and water distribution means, humidifiers typically include a mounted containment base which separately attaches to the air duct or furnace plenum and provides for the housing to be mounted thereon. Also typically included is some sort of water containment device or drain pan disposed below the evaporator means for collecting water run-off. A drain in the bottom of the pan provides an outlet for disposal of any excess water. The production of each of these separate parts further add to the cost of manufacturing a humidifier. Thus, it is believed desirable to reduce the number of parts and, in turn, the cost of production thereof.

In addition to these parts, a water solenoid is often disposed outside of the housing to control the flow of water to the humidifier. Typically, the solenoid is held in place by a bracket or similar means for attaching it to the housing. See, for example, the drawings in U.S. Pat. Nos. 3,975,470 and 4,158,679. Unfortunately, having the solenoid on the outside of the housing prevents the humidifier from being placed close to an object adjacent the solenoid. Thus, the need exists for a humidifier which incorporates the water solenoid to the extent that the housing can be placed adjacent an object on any side of the housing.

For those humidifiers not having fans to force air through the humidifier, conduit is often used to provide air flow between the hot air and cold air plenums. The conduit is typically attached to the humidifier using a by-pass collar. Some humidifiers are manufactured so that the humidifier can be placed on either of the hot air or cold air plenum with a by-pass collar extending toward the other plenum.

For example, if the humidifier is installed on the hot air plenum to the right of the cold air plenum, the by-pass collar will preferably extend from the left of the humidifier. On the other hand, if the humidifier is installed on the cold air plenum to the left of the hot air plenum, the humidifier can be reversed, turned upside down, or otherwise reconfigured such that the by-pass collar will extend from the right of the humidifier. Thus, while interchangeable and/or reversible by-pass collars exists, there has not heretofore been a humidifier which will accept an additional by-pass collar. The use of two by-pass collars is believed desirable inasmuch as the performance of the humidifier can be enhanced significant when additional air flows through it. Thus, the need exists for the capability of adding two by-pass collars to the humidifier for performance enhancement.

SUMMARY OF INVENTION

An object of the present invention is, therefore, to provide a means for distributing water that will effectively and uniformly disperse the liquid from a single source to multiple delivery areas.

Another object of the present invention is to provide means for distributing water, as above, that will substantially evenly distribute the liquid over the evaporator pad of a humidifier even when the humidifier is not installed perfectly level.

Still another object of the present invention is to provide means for distributing water, as above, that may distribute water evenly over the evaporator pad of the humidifier regardless of the flow rate of the liquid.

Yet another object of the present invention is to provide means for distributing water, as above, which can, if desired, effectively and uniformly disperse the liquid at a flow rate of about 3 gallons per hour or less.

A further object of the present invention is to provide a humidifier having a liquid distribution tray that substantially evenly distributes liquid from a single source to a plurality of delivery points over the evaporator pad disposed therein, regardless of the flow rate of the liquid and even when the tray is not perfectly level.

Still a further object of the present invention is to provide a humidifier, as above, which requires a fewer number of total parts than heretofore employed, but still adequately supports the evaporator pad and prevents liquid from draining from the evaporator pad into the plenum on which the humidifier is mounted.

Yet a further object of the present invention is to provide a humidifier, as above, wherein the solenoid is disposed inside the housing of the humidifier, thereby permitting the installer to place the humidifier closer to an object located adjacent the solenoid on that side of the housing.

Still another object of the present invention is to provide a humidifier, as above, which allows for the quick and easy installation and removal of the solenoid.

Yet another object of the present invention is to provide a humidifier, as above, which is capable of employing two by-pass collars for increased air flow and enhanced performance of the humidifier.

At least one or more of the foregoing objects, together with the advantages thereof over the known art relating to humidifiers and other air-treating apparatus, which shall become apparent from the specification which follows, are accomplished by the invention as hereinafter described and claimed.

In general, the present invention provides a water distribution tray for substantially uniformly distributing water from a single source to a plurality of preselected delivery sites regardless of the flow rate of the water. The tray comprises a bottom wall having a plurality of openings in fluid communication with the preselected delivery sites, a liquid reception area disposed below the single source of water, a plurality of channels equal to the number of the openings in the bottom wall, each the channel being in fluid communication between the liquid reception area and one of the openings, and a wick disposed in the liquid reception area and in fluid communication with the single source to at least partially absorb the water from the single source and to direct the water into each of the channels in a substantially uniform manner.

Other objects of the present invention which will become apparent herein are attained by an air-treating apparatus comprising a housing, evaporator means mounted in the housing, and water distribution means disposed above the evaporator means for providing a substantially uniformly distributed flow of water to the evaporator means regardless of the flow rate of water. The water distribution means includes a tray comprising a bottom wall having a plurality of openings in fluid communication with said evaporator means, a liquid reception area for receiving water, and a plurality of channels equal to the number of the openings in the bottom wall, each channel being in fluid communication between the liquid reception area and one of the openings, and a wick disposed in the liquid reception area of the tray to at least partially absorb the water received and to direct the water into each of the channels in a substantially uniform manner.

A preferred embodiment of the humidifier or other air-treating apparatus, as well as the water distribution tray, incorporating the concepts of the present invention is disclosed herein by, and with reference to, the annexed drawings that form a part of the specification. The exemplary humidifier and related devices are described in detail without attempting to show all of the various forms and modifications in which the invention might be embodied. As such, the embodiment shown and described herein is illustrative, and as will become apparent to those skilled in the art, can be modified in numerous ways within the spirit and scope of the invention, the invention being defined by the appended claims and their equivalent embodiments, and not by the details of the specification.

PREFERRED EMBODIMENT FOR CARRYING OUT THE INVENTION

Figure 1:
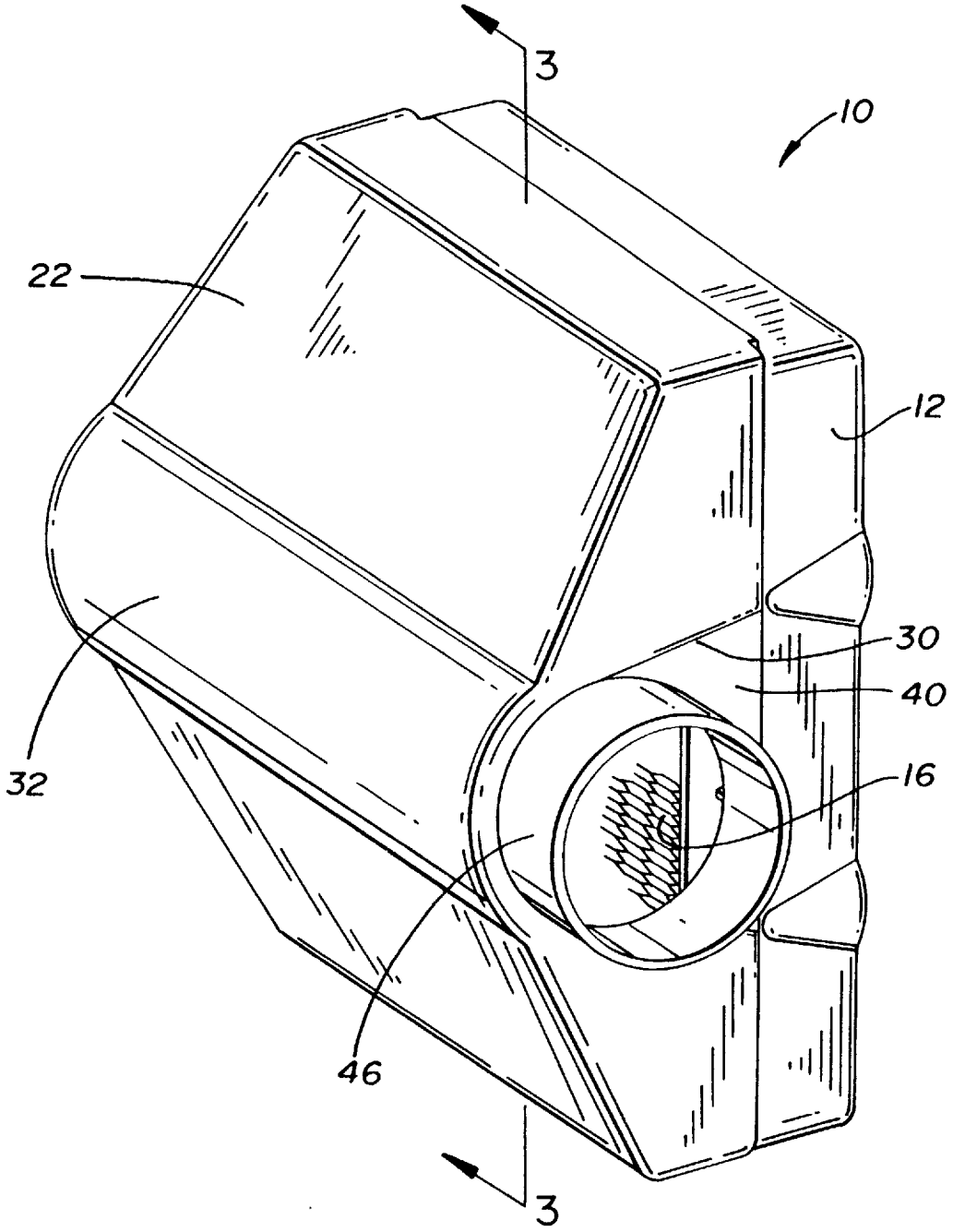
FIG. 1 is a perspective view of a humidifier constructed according to the concepts of the present invention.
Figure 2:
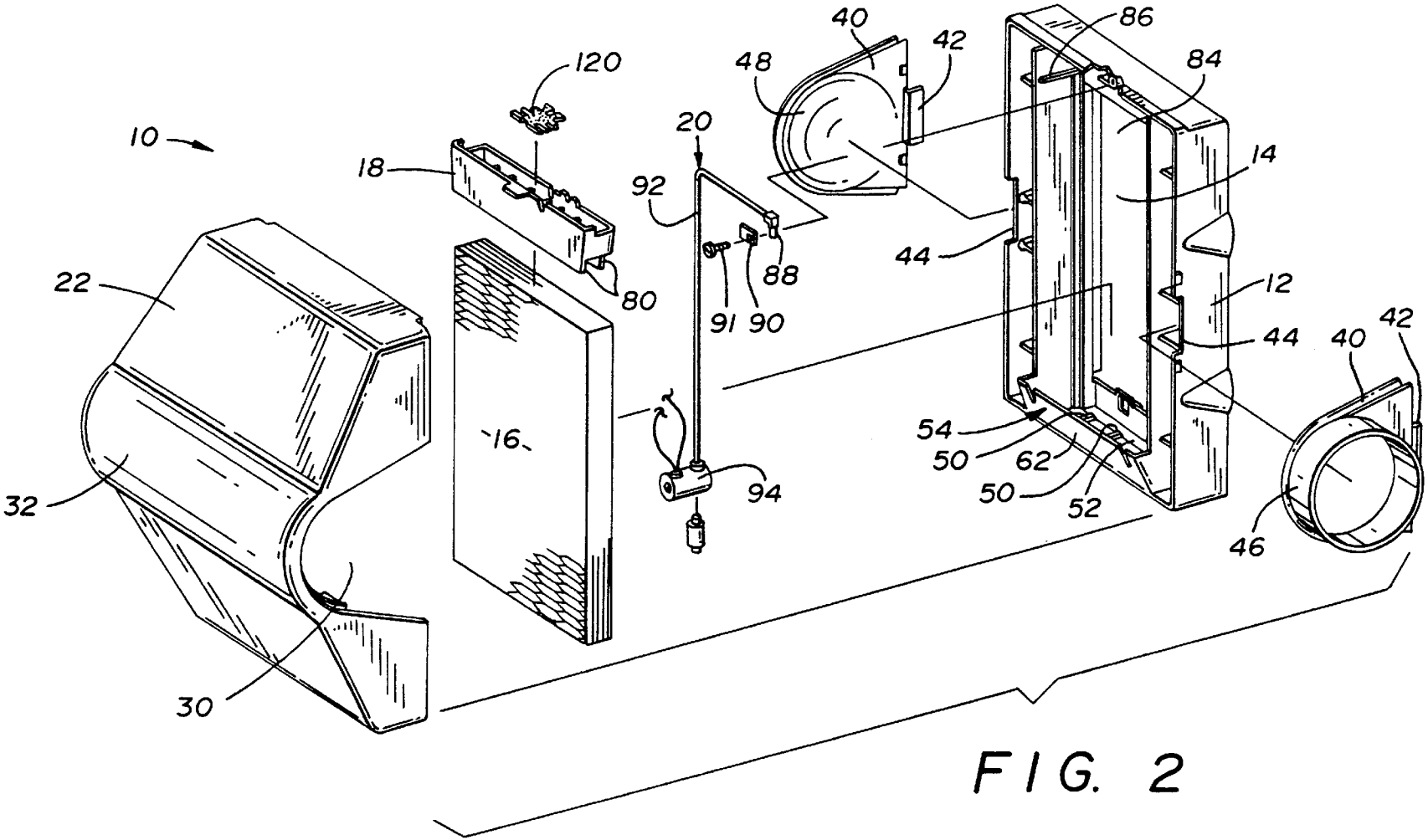
FIG. 2 is an exploded view of the humidifier of FIG. 1.

One representative embodiment of a humidifier or air-treating apparatus is designated generally by the numeral 10 in the accompanying drawings. The humidifier 10 includes a base 12 configured to mount on a plenum (not shown) of an air delivery system (not shown) such as a hot air duct or a cool air return of a forced air furnace, and a cover 22 selectively attached to the base 12 and configured to enclose other components of the humidifier 10. Thus, the base 12 and the cover 22 form a housing for the humidifier 10.

The base 12 defines an opening 14 which, in the embodiment of the invention depicted in the drawings, is shown as being substantially rectangular. Means for evaporating water or other liquids, such as pad 16, is mounted within the housing or, more particularly, the base 12, and substantially covers the opening 14. As noted hereinabove, essentially any evaporator means known in the art and suitable for the purposes set forth herein can be used. While mesh-like evaporator pads comprising multiple layers of water absorbent material are typically employed in air-treating apparatus such as humidifiers, other means such as wood slats, as typically used in cooling towers, and other types of evaporator articles can be employed as well.

Means for uniformly distributing water or like liquid to the evaporator pad 16, such as tray 18, is preferably disposed directly above the pad 16. This distribution tray 18 is in fluid communication with a water delivery system 20 that selectively delivers water to the distribution tray 18.

The humidifier 10 of the type depicted in the drawings functions generally by wetting the evaporator pad 16 with water and allowing the water to evaporate from the pad 16 into the air. To increase the rate of evaporation and move humidified air away from the humidifier 10, it is desirable to create a flow of air to evaporate the water.

One manner in which this might be done is via the use of a fan (not shown) employing an electric motor (not shown). The fan forces air through the evaporator pad 16 and into the plenum. As the air passes through the pad 16, the air becomes humidified.

Alternatively, air may be forced through the pad 16 by way of the natural air flow of the air circulation system of the furnace. When this method is used, the air flow may either be from a plenum (not shown) through the opening 14 and into the apparatus 10 or from the apparatus 10 through the opening 14 and into the plenum (not shown). In any event, a conduit (not shown) may be used to provide air flow between the hot air and cold air plenums. The conduit can be operatively attached at one end to the by-pass collar 46 of the humidifier 10 as discussed hereinbelow, and operatively attached at the other end to the opposite plenum not being used by the humidifier.

Of course, it will be appreciated that, as the water is evaporated from the pad 16, the delivery system 20 rewets the pad 16 so that the pad 16 is continuously moist and can humidify the air flowing through it. Generally, the rate of evaporation increases when the air into which the water is evaporating is heated or moving. Thus, while not necessary, it is often desirable to provide a moving flow of heated air through the pad 16.

Figure 4:
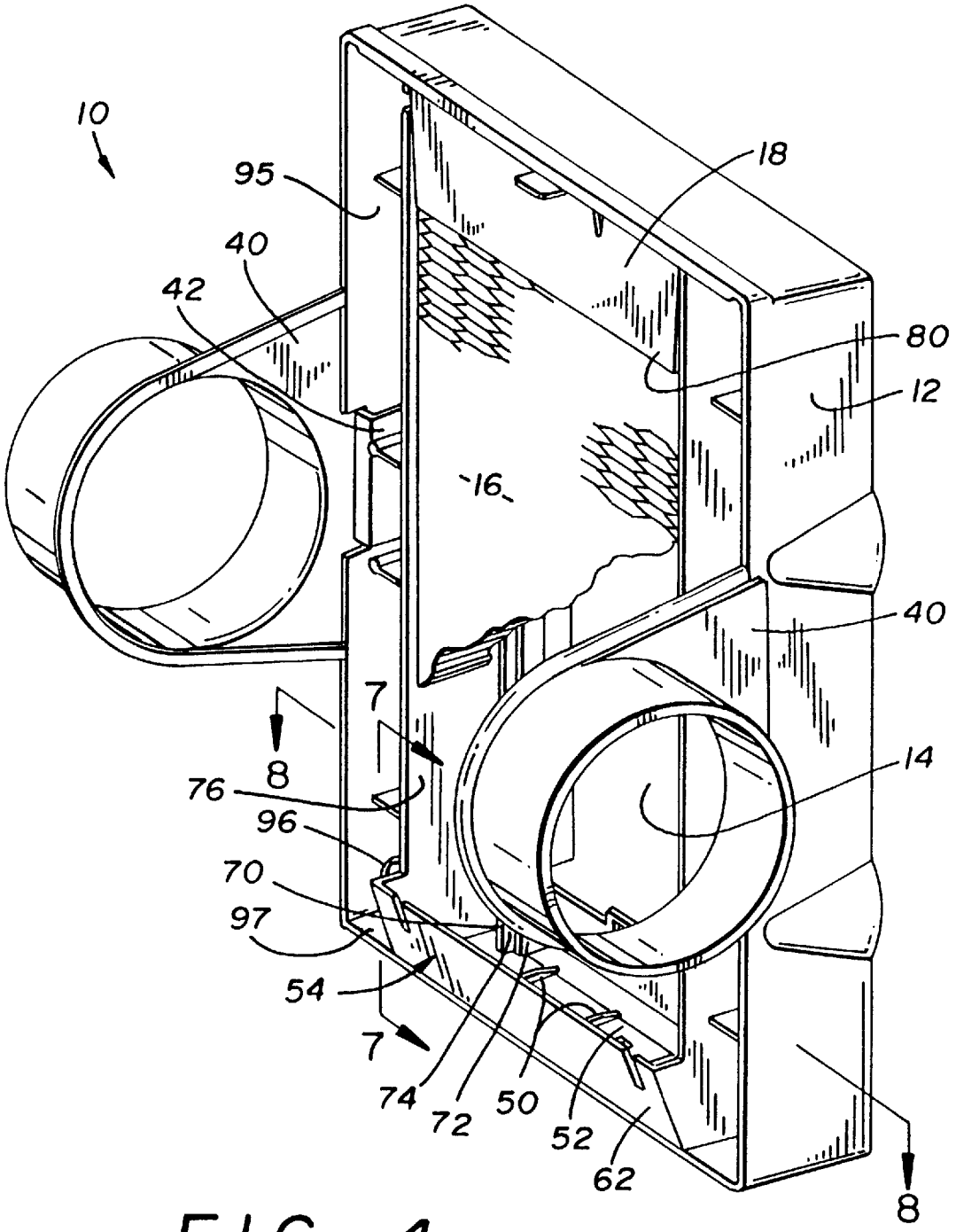
FIG. 4 is a perspective view of the humidifier of FIG. 1, with the housing cover removed and the evaporator pad shown partially in cross section.

Moreover, it is generally believed that the more air flowing through the pad 16, the more efficient the humidifier will be. Thus, the cover 22 of the humidifier 10 of the present invention is configured to selectively accommodate up to two by-pass collars 46 as is shown in FIG. 4 (with cover eliminated) which may be operatively attached to two separate conduits leading to the opposite plenum which conduits can be used to direct airflow through the apparatus 10. Thus, the air flow capacity through the humidifier is significantly increased which, in turn, increases the humidification capacity of the humidifier. As a result, it has been found that the output performance of the humidifier can be increased by at least 20 percent.

More particularly, and in the case where the humidifier 10 is mounted on a cold air return duct, up to two by-pass conduits in operative communication with the forced hot air duct may be connected to the humidifier 10. In this case, forced hot air is obtained directly from the forced hot air duct (not shown) and forced through the pad 16. The cover 22 is configured such that it contains a pair of opposed openings 30 positioned at an enlarged middle section 32 of the cover 22. Each opening 30 is configured to selectively receive an insert 40 that is removably carried by the base 12 by way of the engagement of a tab 42 with a corresponding slot 44. The inserts 40 may either define the by-pass collar 46 that accommodates the connection of the by-pass conduit to the insert 40 or may be a sealing plate 48 which closes the sidewall of the cover 22. Both types of inserts 40 are fabricated to tightly fit with the cover 22 such that the connection between the two is substantially sealed. The inserts 40 are also designed to be interchangeable such that either type 46, 48 of insert 40 may be used on either side of the cover 22.

Thus, as discussed hereinabove, it will be appreciated that, when both inserts are of the sealing plate 48 type, the humidifier 10 may also include a fan (not shown) that draws air through the evaporator pad 16. In such units, the fan may be carried by the cover 22. Upon drawing air through the evaporator pad 16 and moistening the air, the air may be returned to the plenum through openings around the evaporator pad 16.

Figure 3:
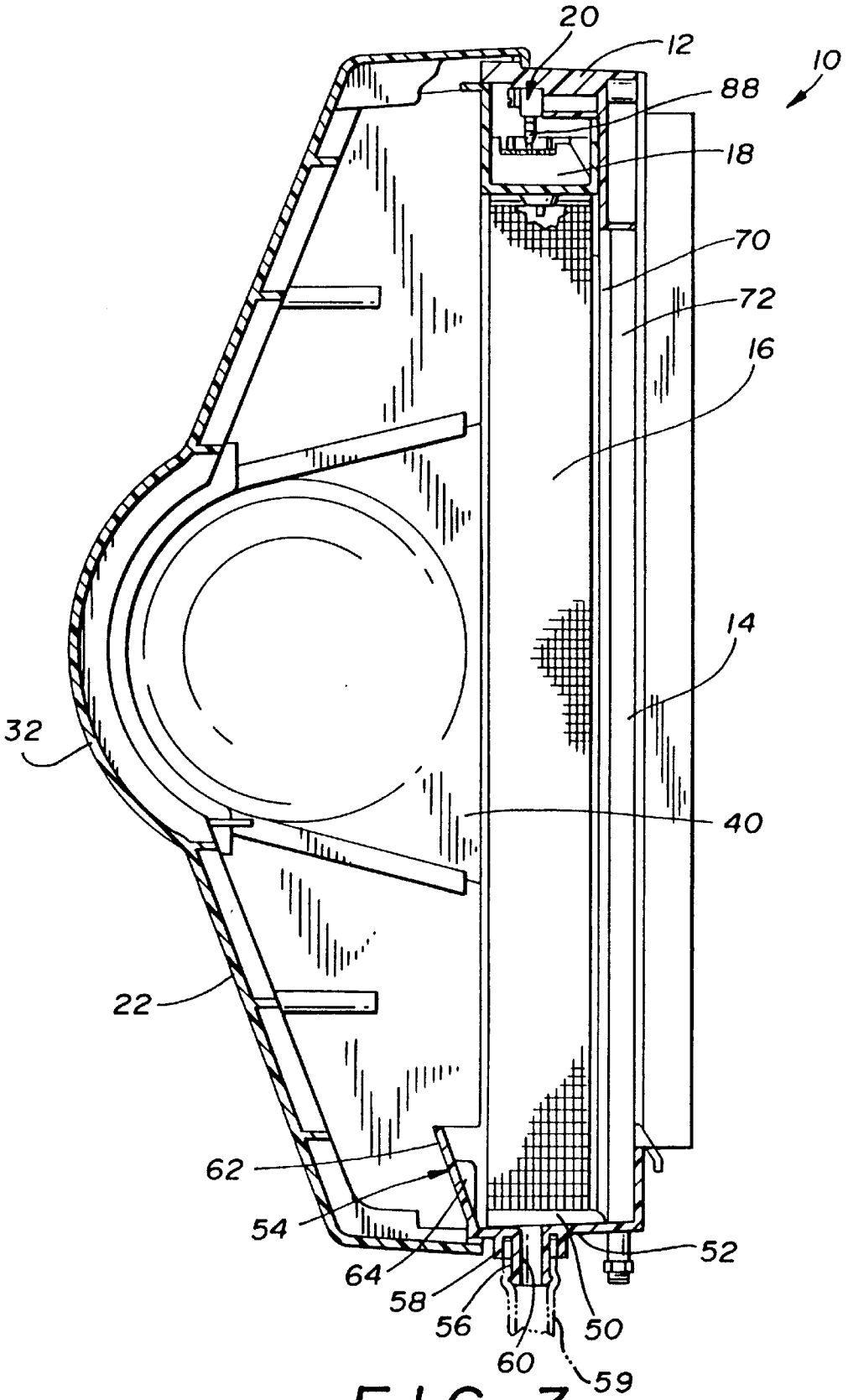
FIG. 3 is a cross-sectional view taken along the line 3—3 in FIG. 1.
Figure 7:
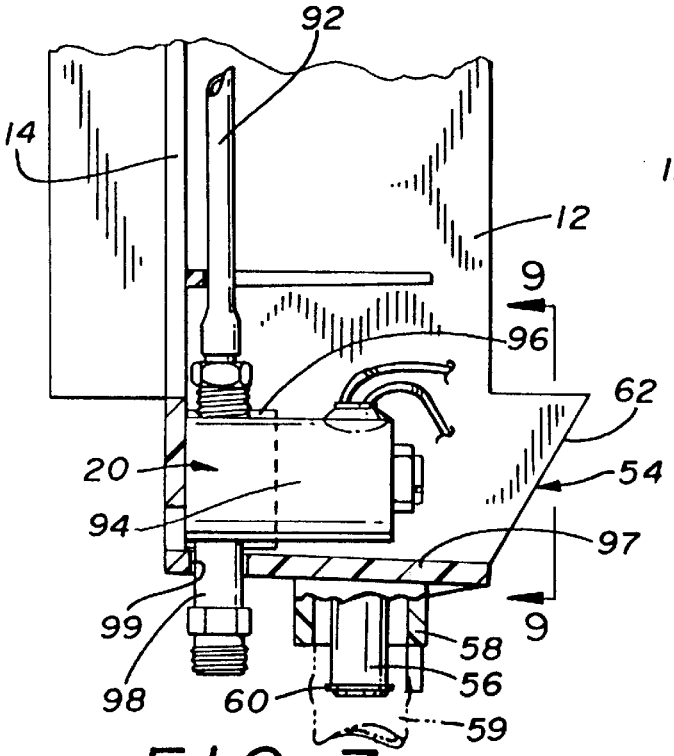
FIG. 7 is a sectional view of a portion of the base of the humidifier depicting the water solenoid taken substantially along line 7—7 in FIG. 4.

The evaporator pad 16 is carried by the humidifier 10 through a plurality of contacts. First, the evaporator pad 16 sits on a plurality of ribs 50 formed in the bottom wall 52 of a collection trough 54 integrally formed in the lower portion of the base 12. The collection trough 54 gathers waste water that flows all of the way down the pad 16 and is not evaporated. A drain tube 56 is preferably centrally disposed in the trough 54, and allows the waste water to drain from the apparatus 10. As more particularly shown in FIG. 7, a cylindrical wall 58 surrounds the drain tube 56 to provide for the connection of an extension pipe or fitting (not shown) made of the same or similar polymeric materials as the base 12. Alternatively, as shown in FIG. 3, the drain tube 56 itself may be employed by connecting flexible tubing 59 over a cylindrical rib 60 disposed on the drain tube 56 to hold the flexible tubing 59 onto the drain tube 56.

In addition to the ribs 50 on the bottom 52 of the trough 54, the front wall 62 of the trough 54 also has a plurality of ribs 64 that engage the front of the pad 16. The pad is positioned between the inner vertical walls 76 of the base 12 and is further supported by those walls 76.

From the rear, the pad 16 is supported by support ribs 70 on either side of the opening 14 which ribs 70 preferably extend substantially the entire height of the pad 16 and in parallel alignment with the inner vertical walls 76 adjacent thereto. A damming rib 72 is presented adjacent to and in parallel alignment with each support rib 70 and more particularly defines the opening 14. Like the support ribs 70, the damming ribs 72 also extend substantially the entire height of the pad 16. However, unlike the support ribs 70, the damming ribs 72 do not contact the rear surface of the pad 16. The support ribs 70 extend further toward the pad 16 than do the damming ribs 72. In this manner, the damming ribs 72 can act as a barrier to the flow of any water which might otherwise run off into the plenum on which the humidifier 10 is mounted.

More particularly, it is generally known that water will flow along surfaces that it contacts due to the surface tension of water. Thus, in prior designs lacking the damming rib 72, water from the evaporator pad 16 would flow along rib 70 and drain out of the opening 14 in the base 12 toward the plenum. Previously, in order to prevent such run-off into the plenum from occurring, a separately mounted containment component was placed around the opening 14 on the mounting base 12. This separate component, like the damming ribs 72 of the present invention, prevented water from running into the plenum. However, it will be appreciated that the ribs 70, 72 are of one-piece construction with the trough 54.

In the preferred embodiment, the damming rib 72 breaks any flow of water toward the plenum and, instead, channels it downwardly toward the collection trough 54. That is, each damming rib 72, in conjunction with its corresponding, adjacent support rib 70, forms a draining channel 74 for channelling the flow of any excess water which might contact the support ribs 70. Thus, the excess water is substantially retained in the draining channels 74 between the two ribs 70, 72 and is prevented from draining out of the opening 14 into the plenum (not shown) on which the humidifier 10 is mounted. All of the water that leaves the evaporator pad 16 by surface contact thus drains down the base 12 and into the trough 54.

The top of the pad 16 is retained between two flanges 80 that extend downwardly from the bottom surface 82 of the distribution tray 18. Thus, it may be understood that the pad 16 is substantially held between the ribs 50, 64 in the trough 54, the vertical walls 76, the support ribs 70, and the flanges 80 of the distribution tray 18. The distribution tray 18 is removably carried by the base 12 in a socket 84 defined by protrusions 86 disposed inwardly of the inner vertical walls 76. Specifically, the protrusion 86 on each vertical wall 76 of the base 12 engages and supports the bottom wall 82 of the distribution tray 18 at the outer edges thereof.

The base 12 is further configured to hold the water delivery system 20. The water delivery system 20 includes a fluid outlet nipple 88 which can be held in place directly above the distribution tray 18 as more particularly detailed hereinbelow, by any means known in the art, including, for example, by washer 90 and screw 91. The nipple 88 is attached to one end of a fluid hose 92 that is used to deliver water to the distribution tray as also set forth in greater detail hereinbelow.

Figure 9:
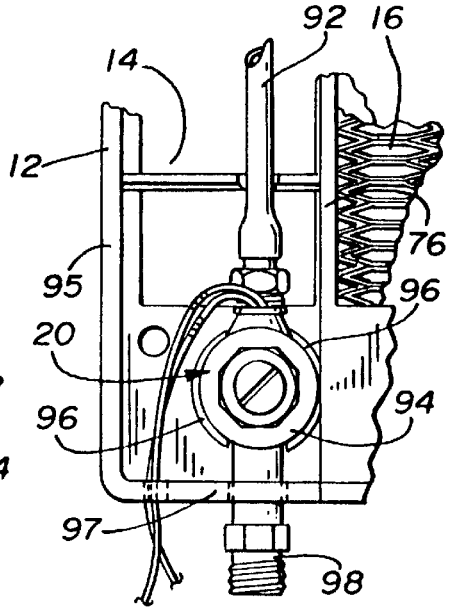
FIG. 9 is a partial, plan view of the base of the humidifier taken substantially along line 9—9 of FIG. 7 showing the solenoid mounting configuration.
Figure 8:
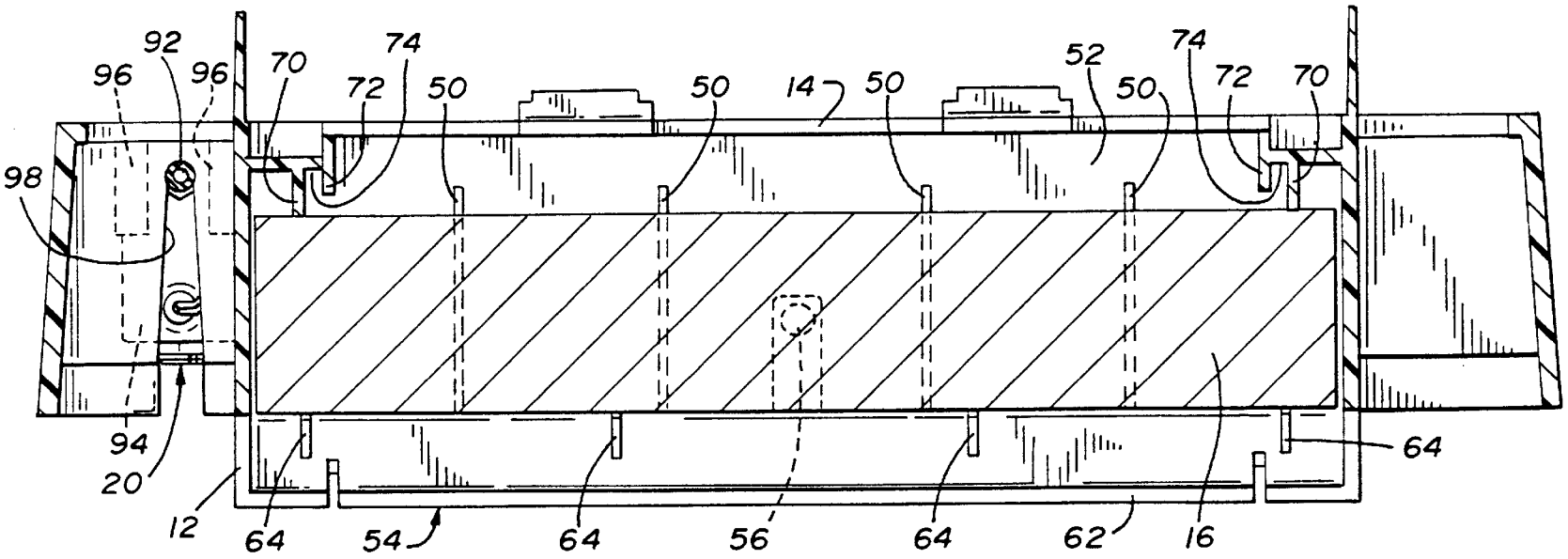
FIG. 8 is a sectional view of the base of the humidifier taken substantially along line 8—8 of FIG. 4.

The other end of the fluid hose 92 communicates with a water solenoid 94 disposed between the inner vertical wall 76 and the outside wall 95 of the base 12. With reference to FIG. 9, it will be appreciated that a pair of arcuate walls 96 define a cavity for receiving the solenoid 94. A fitting 98 can be threadably attached to the solenoid 94 and is received through a hole 99 in the bottom 97 of the base 12. In this manner, it will be appreciated that by removal of only one fitting 98 from the solenoid, the water solenoid 94 can be removed from the base 12 for replacement or repair. There are no additional connectors necessary. It will also be appreciated that the solenoid 94 is also maintained within the walls of the base, thereby permitting installers to install the humidifier closer to the furnace or other objects than would be possible if the solenoid and water delivery system was positioned outside of the humidifier.

Figure 5:
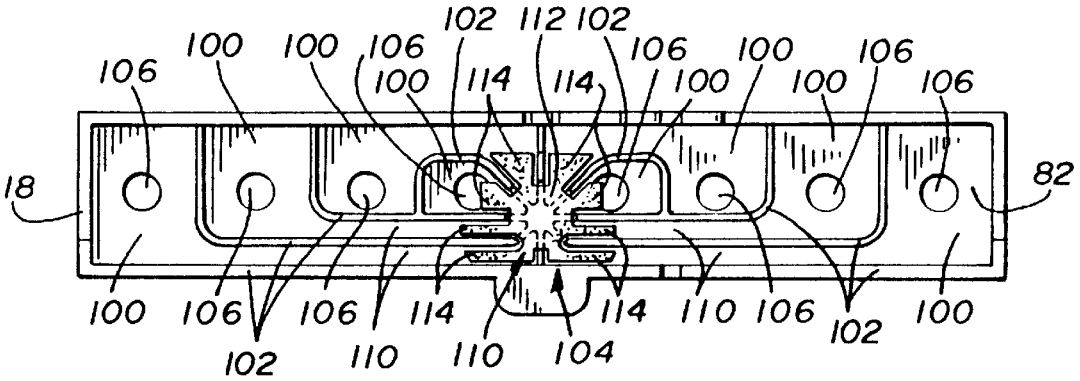
FIG. 5 is a top plan view of a water distribution tray constructed according to the concepts of the present invention.
Figure 6:
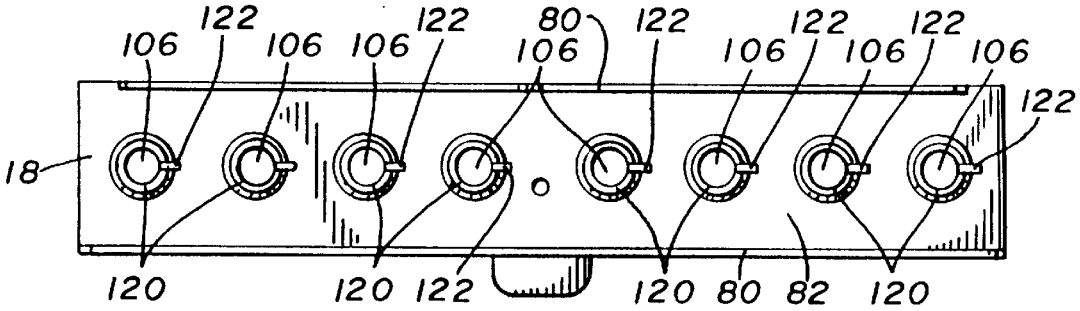
FIG. 6 is a bottom plan view of the water distribution tray of FIG. 5.

With reference to FIGS. 5 and 6, the distribution tray 18 of the present invention constitutes a major improvement over previous distribution trays. A distribution tray 18 according to the concepts of the present invention includes a bottom wall 82 having a plurality of openings 106 therein which are in fluid communication with the evaporator pad 16 so as to deliver the water thereto. As depicted in the drawings, the openings 106 are preferably spread equal distance apart along the central axis of the tray 18. In the manner, the water can be uniformly distributed to the entire evaporator pad 16 provided all of the openings 106 receive water to distribute.

Each opening 106 receives water by way of a channel 100 in fluid communication therewith. Thus, the number of channels 100 employed in the distribution tray is equal to the number of openings 106 in bottom wall 82. The plurality of channels 100 are defined by a plurality of vertical walls 102 extending upwardly from the bottom wall 82. Any overall configuration of these vertical walls 102 may be used, and the present invention is not necessarily limited to the configuration shown in the drawings. The only requirement is that the walls must adequately separate and define each channel 100 such that each channel 100 leads to only one opening 106. In the embodiment of the invention depicted in the drawings, there are eight, substantially equally spaced openings 106 disposed along the central axis of the elongated tray 18. Thus, eight separate channels 100 have been defined by the vertical walls 102.

The tray 18 further includes a liquid reception area 104, located directly below the outlet nipple 88 of the water delivery system 20, to receive the incoming water. Each of the channels 100 are in fluid communication with this liquid reception area, and therefore, it will be appreciated that water received therein can then be directed toward the channels 100 where it is carried to the openings 106 for dispersement over the evaporator pad 16.

It will further be appreciated that, if the distribution tray 18 is installed perfectly level using this configuration, water received at the liquid reception area 104 from the nipple 88 has a substantially equal chance of being distributed to any or all of the channels 100. In fact, because of the relatively small area which constitutes the liquid reception area, only a small amount of water is needed before each of the channels 100 begins to receive water. That is, water from the water delivery system 20 is received by the generally flat liquid reception area 104 which is slightly elevated above the bottom wall 82, but which is below the height of the vertical walls 102. At some point the liquid reception area 104 becomes covered and the water spills substantially uniformly into each of the channels 100 which then directs the flow of water to the openings 106. However, when the distribution tray 18 is not perfectly level, i.e., tilted, the water entering the distribution tray 18 at the reception area 104 flows substantially in the direction of tilt. In this situation, the unequal dispersement of water remains a problem and only a portion of the evaporator pad 16 is wetted as discussed earlier.

To rectify this situation, a wick, generally indicated by the numeral 110 in FIG. 5, is employed. The wick 110 is disposed in the liquid reception area 104 of the distribution tray 18 and is in fluid communication with the water delivery system 20. The wick is particularly useful in that it can direct the water to all of channels 100 regardless of the tilt of the tray 18. Thus, if the tray 18 is tilted to a point where at least one channel would ordinarily not be receiving an adequate amount of water, the wick 110 is able to absorb the water and, through capillary action, is able to direct water to that channel. Thus, each channel 100 receives a substantially equal amount of water to distribute to the openings 106 which, in turn, uniformly distribute the water over the evaporator pad 16.

The wick 110 may be fabricated from any of a variety of water absorbent materials. It has been found that a blend of cotton, synthetic and wood fibers suitably compressed into a rigid, flat sheet is particularly useful as a wick. However, any material capable of absorbing water and directing or moving the absorbed water through capillary action to the channels 100 may be used to form the wick 20.

The wick 110 may be of any configuration suitable and useful for the present invention. However, as shown in FIG. 5, the wick preferably includes a main body portion 112 which substantially covers the liquid reception area 104 and a plurality of capillary arms 114 which extend at least partially into each of the channels 100. The capillary arms 114 are preferably of the same configuration as the channels 100 defined by the vertical walls 102. Thus, as the width of the channels 100 increase, so does the capillary arms 114 of the wick 110. Not only does this configuration insure that the wick 110 will adequately direct the flow of water to each channel as may be needed, but it also insures that the wick will stay in place without the need for glue or other means of preventing the movement of the wick 110, although such means could be employed, if desired.

It should be evident that the use of the wick 110 allows the water to be substantially evenly distributed to all of the channels 100 when the distribution tray 18 is not perfectly level. The wick 110 functions by absorbing the water and pushing the water into each of the channels 100 through capillary action. As such, no specific flow rate into the distribution tray 18 is required to maintain substantially even water distribution. The wick 110 continues it capillary action even when the flow rate is slowed to a slow, intermittent drip which may be timed to approximate the evaporation rate. When such corresponding timing occurs, no waste water reaches the trough 54 at the bottom of the base 12 and the apparatus functions with perfect efficiently. However, as the evaporation rate of the water is not constant and depends somewhat on the moisture content of the air being humidified, it is recommended that a flow rate of about 3 gallons of water per hour be employed.

The bottom of the distribution tray 18 may be seen in FIG. 6. Each of the openings 106 of bottom wall 82 is surrounded by a cylindrical wall 120 that prevents water from moving onto the bottom surface of the wall 82 through the result of surface tension. Each wall 120 has a protuberance 122 extending downwardly from the opening 106 that helps to break the surface tension of the water as it passes through the opening 106 to the evaporator pad 16.

Thus, it should be evident that the air-treating apparatus 10 of the present invention is highly effective in channeling and dispersing water substantially uniformly from a single source to multiple delivery points which, because of the position of the delivery points, results in complete usage of the evaporator pad 16 surface area. The invention is particularly suited for air furnace-mounted humidifiers of the type which are attached to the air duct or the plenum chamber of a furnace, but is not necessarily limited thereto. The apparatus 10 of the present invention may also be suitable for free-standing humidifiers or similar air-treating apparatus, as well as those air-treating apparatus which are capable of being placed in windows and the like.

The water distribution means of the present invention may also be seen as suitable for use in various other applications in an altogether different industry such as agriculture. For example, the water distribution means may be particularly effective in horticultural irrigation, drip feeding and watering. Because the flow of water, i.e., the flow rate, can be controlled and varied, and because the water can be substantially uniformly distributed over any particular area not just an evaporator pad 16, the water distribution means of the present invention would appear to be highly effective as a continuous watering system for greenhouses and other places where uniform irrigation is desirable.

Based upon the foregoing disclosure, it should now be apparent that the use of the air-treating apparatus 10 and its water distribution tray 18 described herein will carry out the objects set forth hereinabove. It is, therefore, to be understood that any variations evident fall within the scope of the claimed invention and thus, the selection of specific component elements can be determined without departing from the spirit of the invention herein disclosed and described. Thus, the scope of the invention shall include all modifications and variations that may fall within the scope of the attached claims.

What is claimed is:

1. A water distribution tray for substantially uniformly distributing water from a single source to a plurality of preselected delivery sites regardless of the flow rate of the water, said tray comprising a bottom wall having a plurality of openings in fluid communication with said preselected delivery sites; a liquid reception area disposed below said single source of water; a plurality of channels equal to the number of said openings in said bottom wall, each said channel being in fluid communication between said liquid reception area and one of said openings; and a wick disposed in said liquid reception area and in direct fluid communication with said single source such that said water from said single source first contacts said wick and is at least partially absorbed thereby to direct said water into at least two of said channels in a substantially uniform manner.

2. A water distribution tray according to claim 1, wherein said wick extends at least partially into each of said channels.

3. A water distribution tray according to claim 1, wherein said wick is a rigid, flat sheet of water absorbent material.

4. A water distribution tray according to claim 3, wherein said flat sheet of water absorbent material is made of a blend of cotton, synthetic and wood fibers.

5. A water distribution tray according to claim 1, further comprising a plurality of vertical walls extending upwardly from said bottom wall, said vertical walls defining said plurality of channels.

6. A water distribution tray according to claim 1, wherein water is uniformly dispersed to each opening in said bottom wall regardless of the level of the tray with respect to horizontal.

7. A water distribution tray according to claim 1, wherein said wick is in fluid communication with each of said channels.

* * * * *